United States Patent [19]

Mercer

[11] 4,227,294

[45] Oct. 14, 1980

[54] METHOD OF INSTALLING A FERRULE

[75] Inventor: Robert R. Mercer, Ortonville, Mich.

[73] Assignee: General Motors Corporation, Detroit, Mich.

[21] Appl. No.: 954,751

[22] Filed: Oct. 26, 1978

[51] Int. Cl.[3] ..... B21D 39/00; B23P 11/00

[52] U.S. Cl. ..... 29/509; 29/243.52; 227/68

[58] Field of Search ..... 29/509, 512, 243.52; 277/68, 71

[56] References Cited

U.S. PATENT DOCUMENTS

| | | | |
|---|---|---|---|
| 626,722 | 6/1899 | Pusey | 227/68 X |
| 822,527 | 6/1906 | Kappel | 227/68 |
| 1,302,942 | 6/1919 | McMurray | 29/512 |
| 1,437,245 | 11/1922 | Henchcliff | 227/68 X |
| 1,838,973 | 12/1931 | Wilder | 227/68 X |
| 2,325,929 | 8/1943 | Amesbury et al. | 29/509 |
| 3,456,483 | 7/1969 | Crothers et al. | 29/509 UX |
| 3,942,240 | 3/1976 | Gebelius | 227/68 X |
| 4,161,059 | 7/1979 | Francois | 227/68 X |

*Primary Examiner*—Charlie T. Moon
*Attorney, Agent, or Firm*—Charles R. Engle

[57] ABSTRACT

A two part die set and method including an upper die half supporting a male die and a lower die half containing a spring biased female die receiving the male die and cutting out an area of a panel placed therebetween. The die set is actuated by a conventional machine press of the type having a ram movable toward a fixed bed. The male punch includes a shank and an annular groove forming an area of reduced diameter supporting a ferrule with integral fastening tines. Extended movement of the punch into engagement with the panel cuts out an area of said panel and further extended movement moves the tines through the panel. Continued extended movement of the male die moves the ferrule downwardly and engages angular portions of the tines with the peripheral edge of the cut out in the panel deflecting the tines outwardly on the underneath side of the panel. Further downward movement of the male die engages its shank with the tines and forces them into frictional engagement with the peripheral edge of the panel cut out deforming a portion of the panel downwardly permanently forming a countersink in the panel around the cut out. The ferrule includes a flange in contact with the upper surface of the panel. The upper die half also has a downwardly extending abutment that engages a spring biased carriage assembly and the female die. The carriage assembly and female die are moved downwardly against the force of their biasing springs until a latching detent is cammed away from a latching surface on the female die. The female die is released permitting its biasing spring to rapidy move it upwardly clenching the ferrule tines against the underneath side of the panel securing the ferrule in place.

3 Claims, 6 Drawing Figures

METHOD OF INSTALLING A FERRULE

TECHNICAL FIELD

This invention relates to a method and apparatus for sequentially cutting an area of a panel and fastening a ferrule within the cut out area. More specifically, this invention relates to a method and apparatus for sequentially cutting an area out of the panel and fastening the ferrule within the cut out area in a single operation.

THE INVENTION

The apparatus of this invention preferably includes a two part die set wherein an upper die half supporting a male punch member engages a spring biased female die member secured in a lower die half permitting the panel to be cut out as the male punch engages the female die in its initial downward movement. The male punch member has an area of reduced diameter supporting a ferrule having integral downwardly extending tines. Further movement of the male punch member downwardly after cutting the area out of the panel member, causes the ferrule and its fastening tines to be inserted within the cut out portion. Continued movement of the male punch member into the female die causes the tines to be cammed outwardly away from the punch member underneath the panel member and at a predetermined point in time during further downward movement, the spring biased female die is released permitting it to move rapidly upwardly clenching the tines against the underneath side of the panel firmly securing the ferrule in place.

THE DRAWINGS

BEST MODE FOR CARRYING OUT THE INVENTION

Figure 1:
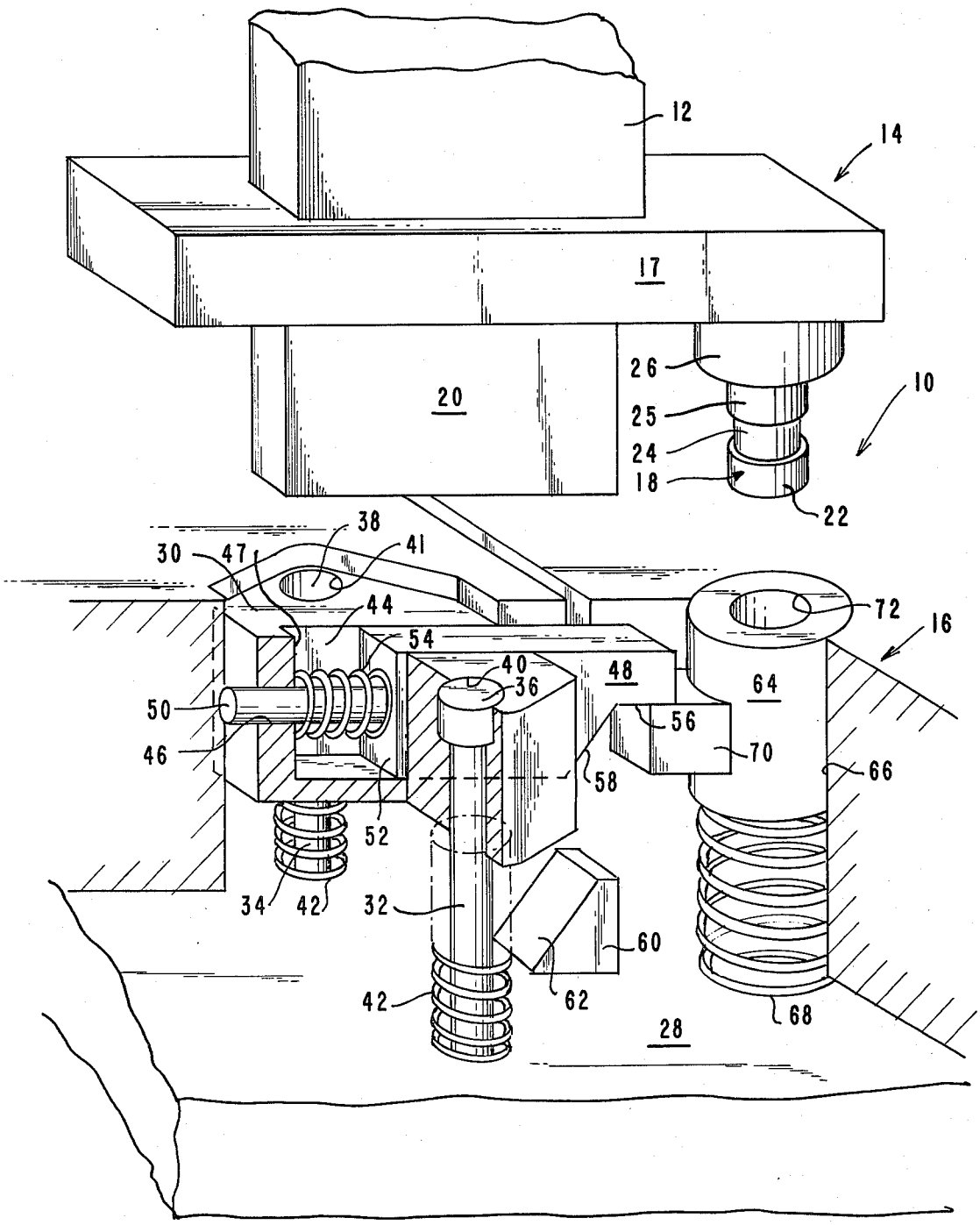
FIG. 1 is a perspective view, partly in section, illustrating the specific elements of the die set position on a machine tool for actuation thereby.

With reference now to FIG. 1, the subject invention comprises a die set 10 of the type adaptable to be actuated by a conventional press assembly including a ram member 12 when the die set 10 is placed upon a bed of the press assembly not shown. The die set 10 includes an upper die half 14 and a lower die half 16. The upper die half 14 includes an anvil member 17 fixedly supporting a male punch die 18 and an abutment 20. The male die 18 includes a cutting end 22 and an area of reduced diameter defining an annular groove 24 for a purpose to be later described. The male die 18 also includes a shank 25 of a diameter equal to that of the punch cutting end, also for a purpose to be later described.

The lower die half 16 includes a housing assembly 28 containing a spring biased carriage 30 including supporting pins 32 and 34 which are secured to the housing assembly 28 and terminate in enlarged head portions 36 and 38 received respectively in counterbores 40 and 41 in the carriage 30. Like springs 42 are each concentrically positioned upon the pins 32 and 34 and engage the underneath side of carriage 30 biasing it upwardly against head portions 36 and 38 of the pins in counterbores 40 and 41.

The carriage 30 contains a laterally extending slot 44 and a lateral axially aligned drilled hole 46 at a closed end 47 of the slot. A detent member 48 is slidably mounted in the slot 44 and has a guide pin 50 fixedly attached to end 52 receiving a coil spring 54 concentrically positioned upon the guide pin 50. Spring 54 engages the slot closed end 47 and end 52 of the detent 48 continuously urging the detent toward an extended position outwardly of the carriage 30. The detent is formed to include a locking surface 56 and a first cam surface 58. An abutment 60 is affixed to the housing assembly 28 and includes a second cam surface 62 complimentary to surface 58 of detent 48.

A female die 64 is slidably positioned in an annular groove 66 formed in housing 28 and is biased upwardly by a spring 68. The die 64 includes a latching lug 70 which normally engages locking surface 56 of the detent 48 by virtue of the biasing force of spring 68. The female die 64 contains a cutting recess 72 which is formed to mate with cutting end 22 of the male die 18 and perform the cutting of a panel member positioned therebetween.

Figure 2:
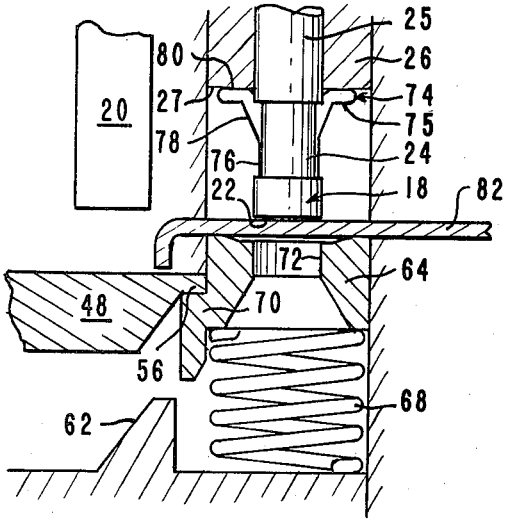
FIG. 2 is a fragmentary side elevational view taken in section illustrating the association of the male and female dies relative to a panel placed on the female die.

Referring now to FIG. 2, a ferrule or reinforcing member 74, having a retaining flange 75 and including fastening tines 76 being connected to the ferrule 74 by angular portions 78, is placed upon the male cutting die 18 with the tines 76 positioned in annular groove 24 above cutting end 22. An upper surface 80 of the ferrule flange 75 engages the underneath side 27 of bushing 26 for a purpose to be later described. A panel member 82 to be cut is placed between the male die 18 and the female die 64.

Figure 3:
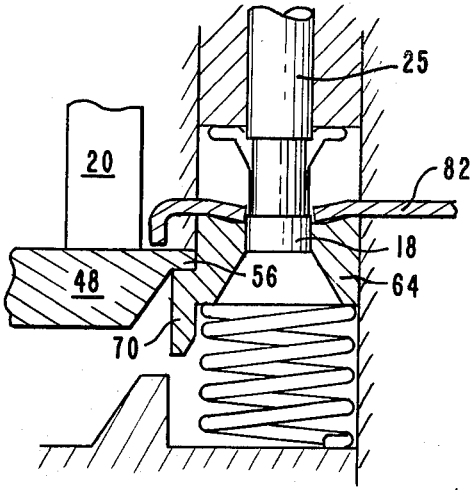
FIG. 3 is a fragmentary side elevational view in section illustrating initial movement of the male die member through the panel and into the female die.

Referring to FIG. 3, it can be seen that to perform a cutting operation the male die 18 moves downwardly through the panel member 82 into female die member 64 while simultaneously the abutment 20 engages detent 48. At this time the detent 48 is in position with locking surface 56 engaging latching lug 70 of the female die 64 so that die 64 moves downwardly with the abutment 20.

Figure 4:
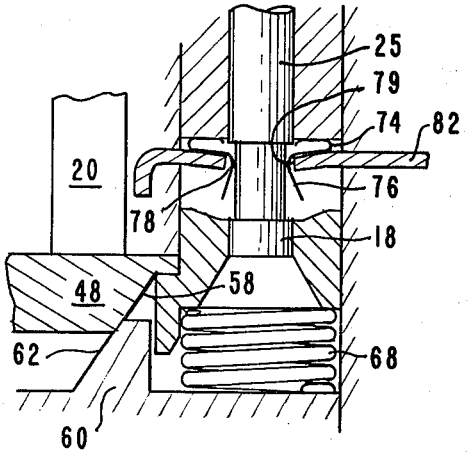
FIG. 4 is a fragmentary side elevational view in section illustrating the male die at a further extended position moving a ferrule placed upon the male die member into the cut out area of the panel.

In FIG. 4, the male cutting die 18 has progressed further downwardly engaging annular portions 78 with a circumferential edge 79 of the cut out area causing the tines 76 to flare outwardly away from the cutting die 18 in annular groove 24 as ferrule member 74 is moved through the cut out area in panel 82. The abutment 20 remains in engagement with detent 48 while cam surface 58 is initially brought into contact with mating cam surface 62 on fixed abutment 60. The female die biasing spring 68 is substantially compressed at this time.

Figure 5:
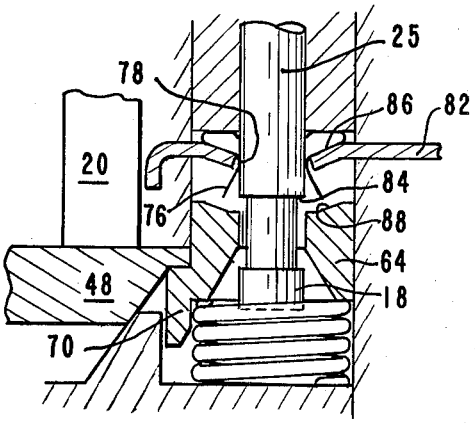
FIG. 5 is a fragmentary side elevational view illustrating movement of the male die to a further extended position wherein portions of the ferrule and the male die have engaged the edges of the cut out portion deforming the panel forming a countersink therein.
Figure 6:
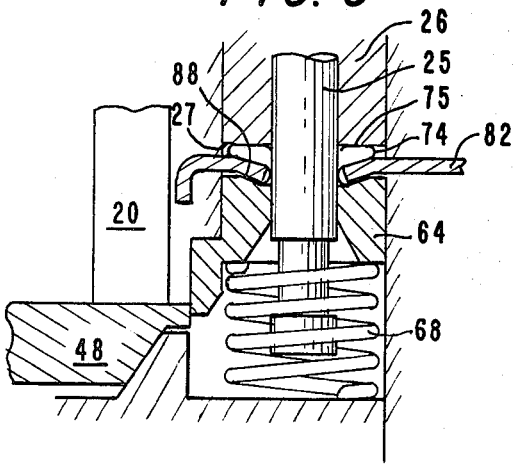
FIG. 6 is a fragmentary side elevational view taken in section illustrating the female die being released from a detent whereby it is spring biased upwardly against the underneath side of the panel countersink clenching tines of the ferrule against the underneath side of the panel securing the ferrule in place.

With reference to FIG. 5, the male die member 18 has progressed yet further downwardly and has moved shank 25 of the male die into engagement with tines 76 which in turn are in engagement with the circumferential edge 79 of the cut out area resulting in a frictional interfering engagement with the panel 82. The shank 25 is slightly tapered adjacent groove 24 providing an annular countersink camming surface 84. This interfering contact forces an area around the cut out downwardly to permanently deform the panel providing a countersink 86 around the cut out area. To accomplish this result the shank 25 is of a predetermined diameter which can be substantially equal to that of the cutting end 22. The female die 64 contains a countersink recess 88 in its upper surface which substantially conforms to the countersink 86 as shown in FIG. 6. Second cam surface 62 eventually moves detent 48 out of engagement with abutment 60 releasing the female die 64. The tines 76 are bent back against the underneath side of the panel 82 when the female die 64 moves rapidly upwardly to the position shown in FIG. 6. Since the countersink recess 88 in female die 64 substantially conforms to the countersink 86 in panel 82 the tines 76 are bent back against the underneath side of the panel 82 in substantial conformance with the countersink 86.

In operation, a ferrule 74 is placed in groove 24 of male die 18 and a panel member 82 is positioned upon female die 64. The ram 12 supporting die 18 is actuated to rapidly move the die downwardly. Cutting end 22 engages and cuts the panel 82 and abutment 20 begins to move female die 64 downwardly against the force of spring 68. Of course, the male die 18 and female die 64 can be of any form to provide a panel cut out area of a predetermined desired configuration, the disclosed circular configuration being a preferred form for purposes of illustration only. The ferrule 74 is eventually moved into the cut out and angular tine portions 78 engage edge 79 of the panel cut out area causing the tines to be deflected outwardly away from groove 24 in male die 18. At about this time as the downward movement continues, detent cam surface 58 engages mating surface 62 of the cam abutment 60. This begins initial compression of detent biasing spring 54 best illustrated in FIG. 1. As shown in FIG. 4, the female die biasing spring 68 is substantially compressed.

Further downward movement places punch shank 25 into the panel cut out area in contact with tine angular portions 78 moving them into a frictional interference engagement with edge 79 of the panel 82. Continued downward movement of the punch shank in this interference engagement permanently deforms the panel 82 to contain the countersink 86 around the cut out area. Detent 48 is also moved laterally away from the female die 64 against spring 54 removing locking surface 56 from engagement with stop member 70 thereby unlatching the female die 64. Spring 68 rapidly moves female die 64 upwardly engaging the die countersink recess 88 with tines 76 reverse bending them against the underneath side of the countersink 86 in panel 82. This reverse bending of the tines 76 is facilitated by the downward movement of bushing 26 with its end surface 27 in contact with the upper surface of ferrule flange 75 holding the ferrule 74 in place while the tines are engaged by die surface 88. The reverse bending of the tines 76 fixedly secures the ferrule in the panel cut out.

While I have shown and described a specific embodiment of the present invention it will, of course, be understood that various modifications and alternative constructions may be made without departing from its true spirit and scope. In particular, it is possible to vary the specific configuration of the cut out in the panel 82 by so designing the male die 18 and the female die 64 to any desired form. With these possibilities in mind, therefore, I intend by the appended claims to cover all modifications of the subject invention which fall within their true spirit and scope.

I claim:

1. A method of sequentially cutting out an installation area and fastening a reinforcing member in the cut out area of a panel member composed of a permanently deformable material through use of engageable male and female cutting dies; said male and female dies capable of being mounted on a conventional press so that one of said dies may be advanced toward the other and retracted therefrom; the male die including an annular groove receiving fastening portions of the reinforcing member to be installed in said panel; said male die further including a shank countersinking surface; an abutment surface movable with said male die and positioned for engagement with said female die when one of said dies is advanced toward the other; the female die being normally spring biased to a cutting position and movable to a spring compressed position by said abutment when one of said dies is advanced toward the other; the method comprising the steps of: positioning the panel on said female cutting die; placing a reinforcing member on said male cutting die with its fastening portions in said annular groove; punching a cut out area in said panel by initially advancing one of said dies toward the other moving said male die into said female die; moving said female die against and compressing its biasing spring through engagement of said abutment with said female die; moving said reinforcing member fastening portions through said cut out area as the one said moving die is advanced toward the other; forming a countersink surface in said panel adjacent said cut out as said male die continues movement into said female die engaging its shank countersinking surface with said fastening portions in an interference engagement with the peripheral edges of said cut out; moving said fastening portions outwardly from said male die as said countersink is formed; and securing said reinforcing member to said panel by releasing said female die permitting its biasing spring to rapidly move it into engagement with said fastening portions clenching them on the underneath side of said panel.

2. A method of sequentially cutting out an area of a panel member composed of a permanently deformable material and fastening a reinforcing member in the cut out through use of selectively engaged mating male and female dies; the male die having a cutting end, an area of reduced cross section, and a shank portion; and the female die being resiliently mounted in a spring biased cutting position; the method comprising the steps of: placing the panel on said female die; positioning a reinforcing member having fastening tines on the male die with the tines placed in the area of reduced cross section; moving said male die downwardly cutting out an area in said panel; moving said reinforcing member into the cut out area with its tines extending through said panel as said male die further advances; engaging arcuate surfaces on said tines with the peripheral surface defining said cut out in said panel moving said tines outwardly away from the male die engaging flanges on said reinforcing member with the upper surface of said panel; moving an abutment surface on said male die into engagement with a surface on said female die moving said female die downwardly away from said tines against the force of its biasing spring; advancing the male die a sufficient distance through said cut out area to engage said shank portion of said male die with the tines in said cut out in an interference fit with the peripheral edge of said cut out depressing the permanently deformable panel around the area of said cut out forming a countersink therein; releasing said female die as said male die further advances permitting its compressed biasing spring to rapidly move the female die upwardly against the underneath side of the panel clenching said tines by reverse bending them against the underneath side of said panel securing said reinforcing member in place.

3. A method of sequentially cutting out an area of a panel member and fastening a ferrule reinforcing member in the cut out through use of selectively engaged mating male and female dies, the male die having an area of reduced cross section and the female die being resiliently mounted into a spring biased cutting position, the method comprising the steps of: placing the panel member between the male and female die members, positioning a ferrule in the area of reduced cross section on the male die, cutting out an area of the panel by moving said male die into said female die, expanding fastening tines extending from the reinforcing ferrule through engagement of a camming surface on said male die, countersinking an area in said panel member by forcing the male die into an interference fit with the peripheral edges of the cut out of said panel when the male die cam surface engages the ferrule tines, compressing the spring biasing said female die to its cutting position by moving said female die against said spring as said male die moves into said female die, releasing said female die from movement with said male die permitting the spring to rapidly move said female die toward said panel, and clenching said tines back against the underneath side of said panel in the area of the countersink in said panel as a mating countersink surface in said female die engages the ferrule tines thereby fixedly securing the ferrule in the panel cut out.

* * * * *